US008860316B2

(12) United States Patent
Barrilleaux

(10) Patent No.: US 8,860,316 B2
(45) Date of Patent: Oct. 14, 2014

(54) SELECTIVE LIGHT SENSOR AND DAYLIGHT MANAGEMENT

(75) Inventor: Jonathan M. Barrilleaux, Oakland, CA (US)

(73) Assignee: Redwood Systems, Inc., Fremont, CA (US)

( * ) Notice: Subject to any disclaimer, the term of this patent is extended or adjusted under 35 U.S.C. 154(b) by 389 days.

(21) Appl. No.: 13/328,313

(22) Filed: Dec. 16, 2011

(65) Prior Publication Data

US 2013/0154486 A1 Jun. 20, 2013

(51) Int. Cl.
*H05B 37/02* (2006.01)
*G05F 1/00* (2006.01)

(52) U.S. Cl.
USPC ..... 315/152; 315/291

(58) Field of Classification Search
CPC ..... H05B 37/02; H05B 33/08; F21V 23/04
USPC ..... 315/152–154, 158, 291, 294, 297, 298, 315/362
See application file for complete search history.

(56) References Cited

U.S. PATENT DOCUMENTS

| | | | | |
|---|---|---|---|---|
| 5,446,342 | A | 8/1995 | Nilssen | 315/129 |
| 5,668,446 | A | 9/1997 | Baker | |
| 6,888,633 | B2 | 5/2005 | Vander Jagt et al. | 356/407 |
| 7,014,336 | B1 | 3/2006 | Ducharme et al. | 362/231 |
| 7,387,405 | B2 | 6/2008 | Ducharme et al. | 362/231 |
| 7,520,634 | B2 | 4/2009 | Ducharme et al. | 362/276 |
| 7,689,130 | B2 | 3/2010 | Ashdown | 398/172 |
| 7,919,937 | B2 | 4/2011 | Tracy et al. | 315/307 |
| 8,008,613 | B2 | 8/2011 | Tam | 250/226 |
| 8,575,641 | B2 * | 11/2013 | Zimmerman et al. | 257/98 |
| 2004/0105264 | A1 | 6/2004 | Spero | 362/276 |
| 2005/0110416 | A1 | 5/2005 | Veskovic | 315/149 |
| 2009/0184840 | A1 * | 7/2009 | Veskovic et al. | 340/825.36 |
| 2009/0267540 | A1 | 10/2009 | Chemel et al. | |
| 2009/0284747 | A1 | 11/2009 | Valois | 356/448 |
| 2010/0084992 | A1 | 4/2010 | Valois et al. | 315/291 |
| 2010/0182294 | A1 * | 7/2010 | Roshan et al. | 345/207 |
| 2010/0214082 | A1 | 8/2010 | Covaro et al. | 340/310.12 |
| 2010/0301781 | A1 * | 12/2010 | Budike, Jr. | 315/362 |
| 2010/0315010 | A1 | 12/2010 | Damink et al. | 315/152 |
| 2011/0031897 | A1 | 2/2011 | Henig et al. | 315/297 |
| 2011/0076024 | A1 | 3/2011 | Damink | 398/130 |
| 2011/0089842 | A1 | 4/2011 | Aldrich et al. | 315/152 |
| 2011/0156596 | A1 | 6/2011 | Salsbury | 315/152 |
| 2011/0180687 | A1 | 7/2011 | Rains, Jr. et al. | 250/205 |
| 2011/0199004 | A1 | 8/2011 | Henig et al. | 315/152 |
| 2011/0199020 | A1 | 8/2011 | Henig et al. | 315/294 |
| 2011/0202151 | A1 | 8/2011 | Covaro et al. | 700/90 |
| 2011/0241567 | A1 * | 10/2011 | Covaro et al. | 315/297 |
| 2011/0280561 | A1 * | 11/2011 | Geffert et al. | 396/164 |

OTHER PUBLICATIONS

U.S. Appl. No. 13/328,286, filed Dec. 16, 2011, Barilleaux et al.

* cited by examiner

*Primary Examiner* — Minh D A
(74) *Attorney, Agent, or Firm* — Myers Bigel Sibley & Sajovec, P.A.

(57) ABSTRACT

A system and method for daylight harvesting and/or light management is provided in which a signal from a light sensor is filtered in order to determine the amount of light received from a light fixture in a lighting system and/or from an external light source, such as sunlight even if light is received from multiple light sources. By filtering the signals from the light sensor, an amount of light received from each light source may be determined, and correspondingly controlled to reach a target light level and/or a target balance of light from the multiple light sources.

12 Claims, 3 Drawing Sheets

SELECTIVE LIGHT SENSOR AND DAYLIGHT MANAGEMENT

BACKGROUND

1. Technical Field

This application relates to lighting systems and, in particular, to light management.

2. Related Art

Lighting systems may include light fixtures, light shades, and sensors. When a lighting system is first installed in a building, the light fixtures and the sensors may be electrically coupled to a device that powers the light fixtures and receives information from the sensors. Rooms in the building may be illuminated by the light fixtures. Sunlight (direct or indirect) may enter rooms illuminated by the light fixtures.

SUMMARY

An apparatus may be provided for light management that includes a filter and an adapter circuit. The filter may receive a sensor signal that indicates an amount of light that is detected in a lighting area by a sensor. The filter may generate a filtered signal from the sensor signal such that the filter blocks any component of the sensor signal representing light from a light fixture and passes any component of the sensor signal representing sunlight, where the filtered signal indicates an amount of sunlight in the lighting area. The adapter circuit may transmit an indication of the amount of sunlight in the lighting area to a light management module. The light management module may determine target amount of light to be received from the light fixture in the lighting area and/or to be attenuated by a shading device based on a target light level for the lighting area and on the amount of sunlight in the lighting area. The light management module may cause the adapter circuit to receive a power signal having a target power level at which the light fixture generates the target amount of light, and the adapter circuit may be coupled to the light fixture so that the light fixture receives the power signal having the target power level. Alternatively or in addition, the light management module may cause the adapter circuit to receive a power signal having a target adjustment level at which the shading device attenuates the amount of light received from the second light source, and the adapter circuit may be coupled to the shading device so that the shading device receives the adjustment signal having the target adjustment level.

A system for light management may be provided that includes a sensor, a filter, and a light management module. The sensor may generate a sensor signal that indicates an amount of light that is detected in a lighting area by the sensor. The filter may generate a filtered signal from the sensor signal such that the filter blocks any component of the sensor signal representing light from a first light source and passes any component of the sensor signal representing light from a second light source. The first light source may include a light fixture that illuminates the lighting area. The second light source may be some other source of light, such as a second light fixture or sunlight, which in some examples may be attenuated by a light shading device. The filtered signal may indicate an amount of light in the lighting area that is received from the second light source. The light management module may determine a target amount of light to be received from the first light source and/or the second light source in the lighting area based on a target light level for the lighting area and on the amount of light in the lighting area received from the second light source. The light management module may cause the light fixture to be powered at a target power level at which the light fixture generates the target amount of light. Alternatively or in addition, the light management module may cause the light shading device to be adjusted at a target adjustment level at which the light shading device attenuates light from the second light source.

A method for light management may be provided. A sensor signal may be received that indicates an amount of light that is detected in a lighting area by a sensor. A filtered signal may be generated from the sensor signal by blocking any component of the sensor signal representing light from a first light source and passing any component of the sensor signal representing light from a second light source. The first light source may include a light fixture that illuminates the lighting area. The second light source may be some other source of light, such as a second light fixture or sunlight, which in some examples may be attenuated by a light shading device. The filtered signal may indicate an amount of light in the lighting area that is received from the second light source. A target amount of light to be received from the first light source and/or the second light source in the lighting area may be determined based on a target light level for the lighting area and on the amount of light in the lighting area received from the second light source. The light fixture may be powered at a target power level and/or the shading device may be adjusted to a target adjustment level so that the target light level is achieved in the lighting area.

Further objects and advantages of the present invention will be apparent from the following description, reference being made to the accompanying drawings wherein preferred embodiments of the present invention are shown.

BRIEF DESCRIPTION OF THE DRAWINGS

The embodiments may be better understood with reference to the following drawings and description. The components in the figures are not necessarily to scale, emphasis instead being placed upon illustrating the principles of the invention. Moreover, in the figures, like-referenced numerals designate corresponding parts throughout the different views.

DETAILED DESCRIPTION

Figure 1:
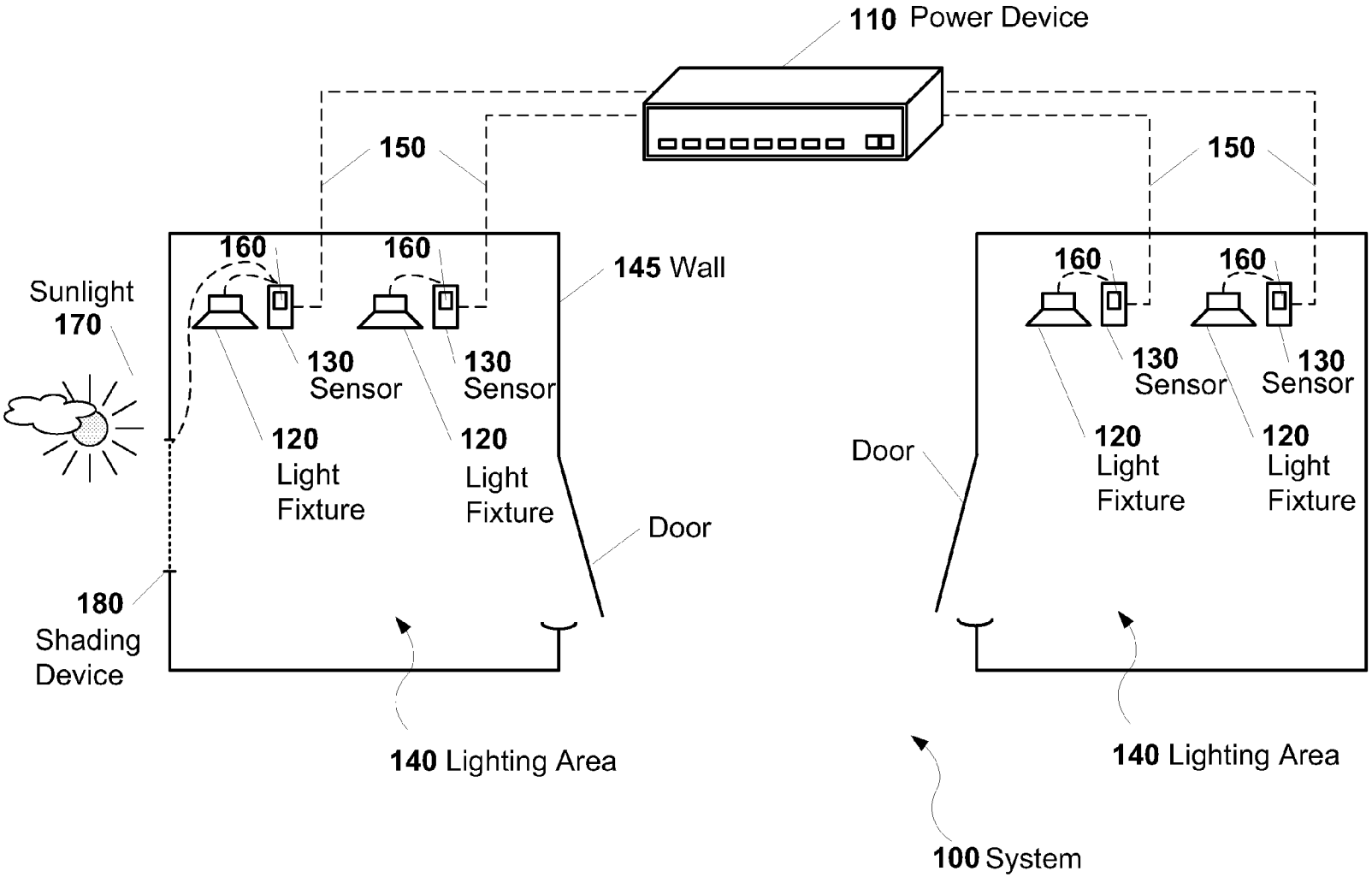
FIG. 1 illustrates an example of a lighting system.

In one example, a system for light management may include one or more light fixtures, a light sensor, a filter, a shading device, and a light management module. The light management module may be included in a power device that powers the light fixture or light fixtures. Alternatively, the light management module may be included in a device external to the power device, such as a laptop or other computing device. The light fixture(s) may illuminate a lighting area. The shading device may attenuate the amount of light in the lighting area received from a second light source, such as sunlight. The sensor may generate a sensor signal that indicates an amount of light in the lighting area detected by the sensor. The filter may generate a filtered signal from the sensor signal such that the filter blocks any component of the sensor signal representing light from the light fixture(s) and passes any component of the sensor signal representing light from the second light source. For example, the filter may include a low-pass filter that passes any frequency component of the sensor signal representing sunlight, such as the frequency components that are in a range of frequencies less than one hertz. Conversely, the low-pass filter may block any frequency components of the sensor signal that are outside of the range of frequencies, such as any frequency components at a modulation frequency of a power signal that powers the light fixture(s). The frequency components at the modulation frequency of the power signal may represent light in the lighting area that is received from the light fixture(s). Accordingly, the filtered signal may indicate the amount of light in the lighting area that is received from the second light source, and not the light received from the light fixture(s). The light management module may determine how much light to add to, or subtract from, the light from the second light source in order to reach a target light level in the lighting area. If light is to be added, then the light management module may cause the light fixture(s) to be powered at a target power level at which the light fixture(s) generate the amount of light to be added so that the target light level is reached in the lighting area. If light is to be subtracted, then the light management module may cause the shading device to reduce the amount of light in the lighting area so that the target light level is reached in the lighting area.

Alternatively or in addition, the system for light management may determine the amount of light received from each respective one of two or more light sources and adjust the amount of light received from one or more of the light sources so that a target balance is reached in the lighting area. The target balance may indicate how much light in the lighting area is to be received from each respective one of the light sources. For example, the target balance may indicate what percentage of the light is to be sunlight, what percentage of light is to be from a wall washer light fixture, and what percentage of the light is to be from some other type of light fixture, such as a troffer light fixture. One or more outputs of the filter may indicate the amount of light received from each one of the light sources. The filter may isolate components of the sensor signal that represent light received from each respective light source if the light generated by each of the light sources may be distinguished from the other respective light sources. The system may adjust the amount of sunlight received in the lighting area by adjusting an amount of shading provided by a motorized awning, window shade, or any other type of shading device. The system may adjust the amount of light received from any of the fixtures by adjusting the amount of power delivered to the respective light fixture. Any light fixture and/or any shading device that is not controlled by the system may also affect the amount of light in the lighting area. The system for light management may adjust the amount of light received from the light fixture(s) and/or the shading device that is controlled by the system in order to compensate for light received from the devices that are not controlled by the system.

Without the filter, the system for light management may not be able to determine the amount of light received from each light source. Without the knowledge of the amount of light received from each light source, the system may just have knowledge of the total amount of light in the lighting area. In a system where just the total amount of light in the lighting area is known, adjusting the amount of light produced by the light fixture until the total amount of light detected by the light sensor reaches the target light level while in the presence of sunlight may produce an unstable system. The amount of sunlight present may vary suddenly, such as when a cloud passes in front of the sun, and the feedback loop may become unstable as a result. Without the filter, variable delays in propagating information from the sensor to the light management module may introduce instabilities. Without the filter, compensating for the delays may result in a system that seems unresponsive to people in or near the lighting area. Without the filter, the system may not be able to distinguish between and, therefore, balance the amount of light received from the light sources. Furthermore, without the filter, the system may not be able to reduce glare.

FIG. 1 illustrates an example of a system 100 for light management. The system 100 for light management may include a power device 110, light fixtures 120, a shading device 180, and sensors 130. The system 100 may include any number of light fixtures 120, shading devices 180, sensors 130, and power devices 110.

Each light fixture 120 or luminaire may be any electrical device or combination of devices that creates artificial light from electricity. The light fixture 120 may distribute, filter or transform the light from one or more lamps included or installed in the light fixture 120. Alternatively or in addition, the light fixture 120 may include one or more lamps. The lamps may include incandescent bulbs, LED lights, fluorescent tubes, any other device now known or later discovered that generates artificial light, or any combination thereof. The light fixture 120 may be located anywhere in or near a lighting area 140. Light generated by one or more light fixtures 120 may illuminate the lighting area 140. The light fixture 120 may be coupled to a ceiling, a floor, a wall 145, or some other surface of a building or physical structure from which the light fixture 120 may project light into the lighting area 140. The light fixtures 120 may illuminate any number of lighting areas 140. When coupled to a surface, the light fixture 120 may be embedded below the surface, installed partially below the surface, positioned on the surface, located in a housing, or positioned in any other suitable configuration with respect to the surface so that the light fixture 120 may transmit light into one or more of the lighting areas 140. The light fixture 120 may be affixed to the surface or be adjacent to the surface. Examples of the light fixture 120 include a compact fluorescent light, a task/wall bracket fixture, a linear fluorescent high-bay, a spot light, a recessed louver light, a desk lamp, a troffer, or any other device that includes one or more lamps.

The lighting area 140 may include any physical space that may be illuminated by one or more of the light fixtures 120. The lighting area 140 may include an area outside of a building, an area inside of a building, a room, a portion of the room, a workspace, any other area that may be lit by at least one of the light fixtures 120, or any combination thereof. The lighting area 140 may be a two-dimensional space or a three-dimensional space.

The shading device 180 may be any device or combination of devices that varies the amount of light that passes through a window or through any other opening, transparent material, or translucent material. Alternatively or in addition, the shading device 180 may vary the spatial distribution of light that passes through a window or opening. Examples of the shading device 180 may include a motorized window shade that moves up and/or down, a switchable window that adjusts the opacity of a window or a position of an awning or blinds or louvers or other surface though which light may pass, be blocked, or be moderated based on an electric signal.

The power device 110 may be any device or combination of devices that supplies power to the light fixtures 120. For example, the power device 110 may include AC/DC (Alternating Current/Direct Current) converters that power the light fixtures 120. Alternatively or in addition, the power device 110 may include DC/DC converters that power the light fixtures 120. The power device 110 may be electrically coupled to each of the light fixtures 120 with twisted-pair wiring, 12 AWG (American Wire Gauge) building wiring, 18 AWG wiring, or any other type of wiring 150.

The power device 110 may provide power to, and communicate with, the sensors 130. Each sensor 130 may be electrically coupled to the wiring 150 that powers a corresponding one of the light fixtures 120. Accordingly, the power device 110 may provide power over the wiring 150 to the sensor 130 and to the corresponding light fixture 120. Alternatively or in addition, each sensor 130 may be electrically coupled to the wiring 150 that powers a corresponding one of the shading devices 180. The power device 110 may provide power, for example, over the wiring 150 to the sensor 130 and to the corresponding shading device 180. Alternatively, the power device 110 may provide control signals over the wiring 150 to the corresponding light fixture 120 and/or the shading device 180, where the light fixture 120 and/or the shading device 180 is powered by a source other than the power device 110. In one example, the corresponding light fixture 120 and/or the corresponding shading device 180 is powered by the power device 110 over wiring other than the wiring 150 that transports the control signals and/or the sensor data.

The sensor 130 may transmit information, such as sensor data, over the wiring 150 to the power device 110. Communication between the sensor 130 and the power device 110 may be unidirectional or bidirectional.

The sensor 130 may be any electrical component or combination of electrical components that detects light. The detected light may include light in the visible spectrum. The sensor 130 may generate a sensor signal that indicates an amount of light detected by the sensor 130. Examples of the sensor 130 include, but are not limited to, a photosensor, an optical detector, a chemical detector, a photoresistor or LDR (light dependent resistor), a photovoltaic cell or solar cell, a photodiode, a photomultiplier tube, a phototransistor, a LED (light emitting diode) reverse-biased to act as a photodiode, an infrared detector, or any other light-sensing device. The sensor 130 may be located anywhere in or near the lighting area 140. In one example, the sensor 130 may be included in the light fixture 120. In a second example, the sensor 130 may be positioned adjacent to or near a corresponding one of the light fixtures 120. In a third example, the sensor 130 may be coupled to a ceiling, a floor, the wall 145, or some other surface of a building or physical structure where light in the lighting area 140 may be detected. When coupled to a surface, the sensor 130 may be embedded below the surface, installed partially below the surface, positioned on the surface, located in a housing, or be positioned in any other suitable configuration with respect to the surface so that the sensor 130 may receive light present in the lighting area 140.

The sensor 130 may include a filter 160. The filter 160 may be any device that blocks a first component of the sensor signal generated by the sensor 130 and passes a second component. For example, the filter 160 may isolate a particular frequency or range of frequencies, or a particular code or range of codes, at which the amplitude of light waves vary. In particular, the filter 160 may generate a filtered signal that includes the isolated frequency or code, range of frequencies or codes, or multiple frequencies or codes. The filter 160 may be implemented as a band-pass filter, a low-pass filter, a high-pass filter, a comb filter, a matched filter, a convolution filter, a correlation filter, a digital signal processor, or any other type of filter or combination of filters. In one example, the filter 160 may include a microcontroller, a microprocessor or some other type of processor or combination of processors (not shown). Accordingly, the processor may operate on the sensor signal, which may represent the light detected by the sensor 130, by processing the sensor signal to generate the filtered signal as a filtered sensor signal. For example, the processor may perform FFTs (fast Fourier transforms) on the sensor signal. The sensor 130 may transmit the filtered signal, or information about the filtered signal, to the power device 110.

During operation of the system 100, the nature of the light waveform generated by the light fixture 120 and corresponding characteristics of a waveform of the sensor signal and/or filtered signal may be distinguished in frequency and/or in time from waveforms generated by, or detected from, other light sources. For example, the light from the light fixture 120 may be modulated such that the sensor signal and/or filtered signal may include information inserted using a Frequency, Code, or Time Division Multiplexing (FDM, CDM, or TDM) scheme, Frequency-Shift Keying (FSK) pulse code modulation (PCM), orthogonal pulse coding, or any other data communication scheme. The waveform isolated in the filtered signal may include information identifying and distinguishing light sources, and/or indicate intensities of light sources. The component of the sensor signal blocked or passed by the filter 160 may be an amplitude of one or more frequencies of the sensor signal in the frequency spectrum or a waveform or pattern, such as a waveform generated by pseudorandom number sequences used in spread-spectrum communication.

More generally, the manner in which the power device 110 powers the light fixture 120 or light fixtures 120 may determine the corresponding characteristics of the light waveform generated by the corresponding light fixture 120. For example, the power device 110 may provide the light fixture 120 with the determined power signal. The predetermined power signal may be a pulse width modulation signal having a modulation frequency or coding. To people in or near the lighting area 140, the light fixture 120 provided with the determined power signal may appear to be turned on and operating normally. Alternatively or in addition, predetermined but unique power signals may be provided to each light fixture 120 in the system 100 or a portion of the system 100 at substantially the same time. Each of the unique power signals may be unique as compared with the other power signals provided to the light fixtures 120. Two or more power signals may be considered provided at substantially the same time if at least a portion of each of the power signals is provided to the light fixtures 120 at the same time. The predetermined or determined power signal may be a pulse width modulation signal. Alternatively or in addition, the predetermined or determined power signal may have any suitable form or forms, such as a sine wave, a square wave, a pulse wave, or any other waveform.

The filtered signal produced by the filter 160 may include a frequency or temporal component that represents sunlight 170 or artificial light controlled by devices other than the power device 110, and exclude one or more frequency or temporal components that represent light generated by one or more of the light fixtures 120. Sunlight 170 or artificial light not controlled by the power device 110 may be referred to as non-system light or external light. Any shading device 180 not controlled by the power device 110 may be referred to as non-system shading or external shading. The light fixtures 120 may produce light having an amplitude that varies at a particular frequency. For example, the power device 110 may power the light fixtures 120 using a pulse width modulated (PWM) signal that has a carrier frequency. The carrier frequency may be the pulse width modulation frequency or other modulation frequency. Alternatively or in addition, the pulse modulation may include a signature identifying the source of the light. The carrier frequency may be high enough that humans do not perceive any flickering of the light produced by the light fixtures 120. The carrier frequency or other component may also be distinct from the component representing light produced by non-system light sources. Examples of non-system light sources may include: sunlight 170, with no frequency component; a fluorescent light that generates light having a line frequency (50/60 hertz) component, or a fluorescent light that includes a switching converter may generate light having a high frequency (e.g. 100 kilohertz) component; an incandescent lamp that generates light having a 60 hertz component; a light source that operates at a different PWM carrier frequency than the light fixtures 120, or any other suitable light source. Examples of non-system shading may include: manually operated awnings, blinds, or shades that may admit system and/or non-system light into the lighting area 140.

Each type of light source may produce a signature waveform that may be unique to that type of light source. For example, a magnetic core & coil-type ballast driving T12 fluorescent tubes may generate light having primarily a 60 hertz component in the frequency spectrum. In contrast, a digital ballast driving T8 fluorescent tubes may cause the fluorescent tubes to generate light having frequency components primarily greater than 100 kilohertz in the frequency spectrum. Incandescent lights may produce light having primarily a frequency component that corresponds to the frequency, such as 60 hertz, of the Alternating Current (AC) that powers the incandescent lights. LEDs powered by the power device 110 may generate light having primarily a frequency component at the carrier frequency or some other frequency. Sunlight 170 may have a stochastic (random) waveform in the very low frequency range (<1 Hz). The filter 160 may be tuned to detect light having the signature waveform of a selected light source so as to determine the amount of light received by the sensor 130 from the selected light source.

For example, the filter 160 may be tuned to block all but a DC (direct current) component of the sensor signal. Accordingly, the filtered signal from the filter 160 may indicate the amount of sunlight 170 in the lighting area 140. Alternatively, the filter 160 may pass a particular set of components, such as frequency components below a threshold frequency, which represent sunlight 170 in the lighting area 140. Alternatively, the filter 160 may be tuned to the carrier frequency of the system 100 and/or to the carrier frequency of one or more of the light fixtures 120. Accordingly, the filtered signal from the filter 160 may indicate the amount of light received from one or more of the light fixtures 120, but not the light received from other sources, such as sunlight 170 or non-system artificial light. Alternatively, the filter 160 may be tuned to pass components of the sensor signal that are specific to a type of non-system light source, such as fluorescent light fixtures. The filter 160 may be pre-tuned to one or more frequencies or components. Alternatively, the filter 160 may be dynamically tuned to one or more target frequencies or components, during operation of the power device 110.

The carrier frequency or pulse coding of light from any of the light fixtures 120 may shift between two or more frequencies or codes. For example, the light fixture 120 may be powered by a pulse-width modulated signal that has a constant duty cycle, but the frequency of the modulation of the pulse-width modulated signal may shift between two modulation frequencies. The frequency of the modulation may shift in order to transmit data from the power device to the light fixture or adapter. As a result, a waveform of the light produced by the light fixture 120 may exhibit the shift between the two modulation frequencies. Accordingly, the filter 160 may include two filters, where each one of the filters isolates a corresponding frequency component of the unfiltered sensor signal at a respective one of the two modulation frequencies. The power device 110 or other component of the system 100 may distinguish light produced by the light fixture 120 from light received from other light sources by determining that the amplitude of the filtered signal produced by the filter 160 exceeds a threshold level. Alternatively, the filter 160 or the sensor 130 may perform signal processing on the output of a single band-pass filter or on the unfiltered sensor signal in order to detect the signature waveform of the light fixture 120.

As noted above, the unfiltered sensor signal from the sensor 130 may represent the detected amount of light from a combination of natural and artificial sources. In other words, the unfiltered sensor signal may indicate the amount of light received from both system and non-system light sources. Therefore, the difference between the unfiltered sensor signal and the filtered signal may represent the amount of detected light that is not produced by the light fixtures 120 of the system 100. Accordingly, the filter 160 may indicate the amount of light in lighting area 140 that is produced by the light fixtures 120 of the system 100, the amount of light in the lighting area 140 that is produced by light sources other than the light fixtures 120, and the total amount of light in the lighting area 140.

Alternatively or in addition, the filter 160 may indicate the amount light in the lighting area 140 produced by any one of the light fixtures 120 without shutting off the other light fixtures 120 and without shading the lighting area 140 from sunlight 170. The system 100 may cause each one of the light fixtures 120, or a selected one of the light fixtures 120, to produce light that has a characteristic distinguishable from light produced by any of the other light fixtures 120. The filter 160 may be tuned to detect light having the distinguishable characteristic when the light fixture 120 produces light with the distinguishable characteristic.

The light having the distinguishable characteristic may have a determined wave shape, frequency, amplitude, timing, or other characteristic. For example, the light may be modulated at an alternate carrier frequency or pulse coding. In other words, the power device 110 may power the light fixture 120 that is to produce light having the distinguishable characteristic at the alternate carrier frequency, and power any other light fixture 120 at a common carrier frequency. The alternate carrier frequency may differ from the common carrier frequency by a predetermined frequency difference. The filter 160 may be tuned to the alternate carrier frequency and block the common carrier frequency. Accordingly, the filtered signal generated by the filter 160 may indicate the amount of light received by the sensor 130 from the light fixture 120 that is powered by the power signal having the alternate carrier frequency. In one example, the light fixtures 120 may be selectively operated at the alternate carrier frequency. The filtered signal generated by the filter 160 may indicate when the sensor 130 receives light from the light fixture 120 that is operated at the alternate carrier frequency. Any of the non-selected light fixtures 120 may be on, and operated at the common carrier frequency, without interfering with the ability of the filter 160 to indicate the amount of light that the sensor 130 received from the light fixture 120 operated at the alternate carrier frequency.

Because the power device 110 may control each of the light fixtures 120, the distinguishable characteristic of the light produced by the selected light fixture 120 may have a timing component. For example, when the amount of light received from the selected light fixture 120 is to be determined, the power device 110 may modulate the power signal that powers the selected light fixture 120 using a random or predetermined pattern stored in the power device 110. The power device 110 may receive, within a predetermined period of time, the filtered signal from one of the sensors 130 that matches the pattern. The filtered signal received within a predetermined period of time may indicate the amount of light in the lighting area 140 received from the selected light fixture 120.

Daylight harvesting is using sunlight 170 or other non-system light (natural or artificial) to reduce the amount of light the system 100 generates in order to illuminate the lighting area 140. More broadly, daylight management may involve actively shading the lighting area 140 to reduce or balance the amount of sunlight 170 or other non-system light received in the lighting area 140. Balancing the amount of light received from system and non-system light sources may be useful for glare mitigation and aesthetics.

The power device 110 in the system 100 for light management may perform daylight harvesting and/or light management. The filter 160 may indicate the amount of sunlight 170 in the lighting area 140. The power device 110 may include a target light level for the lighting area 140. The target light level may be any indicator of an amount of light. For example, the target light level may include a value that corresponds to an output of the sensor 130 and/or the filter 160. The target light level may include a unit or be unitless. The target light level may include a target color or color temperature that indicates what color the light is to have at the target light level. The target light level may be expressed, for example, as a minimum, a maximum, or a combination thereof of light for a typical work surface for a given task.

As described above, the power device 110 may determine the amount of sunlight 170 in the lighting area 140 from the filtered signal. Similarly, the power device 110 may determine the amount of light, if any, generated by one or more light fixtures 120 that illuminate the lighting area 140 from the filtered signal. The power device 110 may adjust the amount of power provided to the light fixture 120 or light fixtures 120 so that the amount of light generated by the light fixture(s) 120 combined with the amount of sunlight 170 equals the target light level. Alternatively or in addition, the power device 110 may adjust the shading provided by the shading device 180 so that the amount of light generated by the light fixture(s) 120 combined with the amount of sunlight 170 equals the target light level. Adjusting the shading provided by the shading device 180 may adjust the amount of sunlight 170 in the lighting area 140.

The target light level may be dynamically determined by the power device 110, set by a dimmer switch, entered by a user via a graphical user interface (GUI) on a mobile device, a hand held device, or a web browser GUI, or obtained in any way. In one example, a lighting designer may set the target light level for each of the lighting areas 140 during site design, and prior to general system operation. In a second example, a system operator may adjust the target light level during setup of the system 100. In a third example, an occupant of the lighting area 140 may adjust the target light level.

A target balance may also be dynamically determined by the power device 110, entered by a user, or obtained in any way. The target balance may indicate how much light in the light area 140 is to be received from each respective one of multiple light sources. For example, the target balance may indicate how much of the light is to be sunlight 170, how much light is to be from a wall washer light fixture, and how much light is to be from some other type of light fixture, such as a troffer light fixture. The target balance may indicate the respective amounts of light in fixed terms or in a formulaic manner, such as according to a particular algorithm. In one example, the target balance may indicate that the amount of light received from the wall washer light fixture should be maintained and not varied. The wall washer light fixture may provide an aesthetic effect, for example. The target balance may further indicate that the amount of sunlight 170 should be maximized unless the amount of light received from the wall washer light fixture combined with the amount of sunlight 170 exceeds the target light level. If the amount of sunlight 170 exceeds the target light level, then the power device 110 may increase the shading provided by the shading device 180 so that the target light level is not exceeded. The target balance may further indicate that the light fixtures 120 are to provide any additional light that may be needed in order to reach the target light level. The additional light may supplement the light received from the wall washer light fixture and the sunlight 170 that passes through the shading device 180. In a second example, the target balance may indicate that a first portion of the light in the lighting area 140 is to be received from a first one of the light fixtures 120 and a second portion of the light is to be received from a second one of the light fixtures 120, and no sunlight 170 is to be received. In a third example, the target balance may include N values, each of which corresponds to amount of light to be received from a corresponding one of N light sources.

The ability to reach the target balance enables the power device 110 to balance location lighting by light fixture type. For example, the power device 110 may balance fluorescent area lighting with LED wall washers. The power device 110 may maintain a light level for the wall washer to create an effect, but adjust fluorescent area lighting for efficiency. Alternatively or in addition, the power device 110 may balance location lighting by individual light fixture 120 instead of grouping light fixtures 120 of a common type together and assigning the group a light level.

The target light level, the target balance, or a combination thereof may address functional aspects of lighting. For example, the target light level may include an amount of light desired by an occupant to effectively perform some task, such as walking in hallway, reading at a desk, or using a computer display. In addition, the target light level, the target balance, or a combination thereof may mitigate the effects of glare, and address less tangible aspects, such as lighting for architectural aesthetics and occupant performance, where occupant performance is affected by a visually pleasing and/or physically and psychologically productive environment. For example, the shading device 180 may attenuate or block a source of glare. In a second example, a wall washer light fixture may provide a desired architectural aesthetic effect.

The system 100 may include more, fewer, or different components than illustrated in FIG. 1. For example, the system 100 may include any number of light fixtures 120, shading devices 180 and sensors 130. In one example, the system 100 may not include any shading device 180. In one example, the system 100 may control the shading device 180 but not the light fixtures 120. The system may include any number of lighting areas 140. The system 100 may include different components, such as input devices or output devices. Examples of input devices include switches and touch-screens. Examples of output devices include a display.

The system 100 may include multiple power devices 110. The power devices 110 may communicate with each other over a network. For example, the power devices 110 may coordinate with each other over the network in order to perform auto-commissioning of the entire lighting system. The network may include a local area network (LAN), a wireless local area network (WLAN), a personal area network (PAN), a wide area network (WAN), the Internet, any other now known or later developed communications network, or any combination thereof.

The system 100 may be implemented in many different ways. For example, the filter 160 may be included in each of the sensors 130 as described above. Alternatively, the filter 160 may be included in a circuit, such as an adapter circuit, that is external to the sensor 130. The external circuit may be electrically coupled to or in communication with the sensor 130. Alternatively, the unfiltered sensor signal from the sensor 130 may be transmitted in digital or analog form to the power device 110, and the power device 110 includes the filter 160 or otherwise performs the filtering.

The sensors 130 are described above as performing a variety of operations, such as communicating with the power device 110. Alternatively or in addition, the same operations may be performed in whole or in part by the circuit external to the sensor 130, such as the adapter circuit. For example, the adapter circuit may include a communication circuit that communicates with the power device 110. The adapter circuit may receive the unfiltered sensor signal from sensor 130, and generate the filtered signal therefrom. Alternatively or in addition, the adapter circuit may transmit the unfiltered sensor signal and/or the filtered signal to the power device 110 with the communication circuit.

In one example, the adapter circuit, instead of the sensor 130, may be electrically coupled to the wiring 150 that powers a corresponding one of the light fixtures 120. The power device 110 may provide power to the sensor 130 via the adapter circuit. Alternatively or in addition, the sensor 130 may be powered by some other source.

In the example illustrated in FIG. 1, there is a one to one correspondence between the light fixtures 120 and the sensors 130. The sensors 130 may be electrically coupled to the power device 110 via the same wiring 150 that couples the light fixtures 120 to the power device 110. Alternatively, the system 100 may not have a one to one correspondence between the light fixtures 120 and the sensors 130. The number of the sensors 130 may be different than the number of the light fixtures 120. One or more of the sensors 130 may be electrically coupled to the power device 110 via wiring that is separate from the wiring 150 that electrically couples the light fixtures 120 to the power device 110.

The communication between the power device 110 and the sensor 130 and/or the adapter circuit may involve any protocol, proprietary or standard. The communication may be over the wiring 150 as illustrated in FIG. 1 or over any other communications network.

The power device 110 is described above as performing a variety of operations. Alternatively or in addition, the same operations may be performed in whole or in part by a control device instead of the power device 110. Examples of the control device include a computing device, a computer, a laptop, a smart phone, a server, an integrated circuit, or any other suitable device. The control device may include a light management module that performs operations of daylight harvesting and/or light management. Alternatively or in addition, the light management module may cause the fixtures 120 to be powered, and/or the shading device 180 to be adjusted, such that the target balance of light from multiple light sources is reached.

In one example, the filter 160 may be a light management filter that is used only for light management. Alternatively, the filter 160 may be used for purposes in addition to light management. For example, the filter 160 may also be used for auto-commissioning a lighting system.

Figure 2:
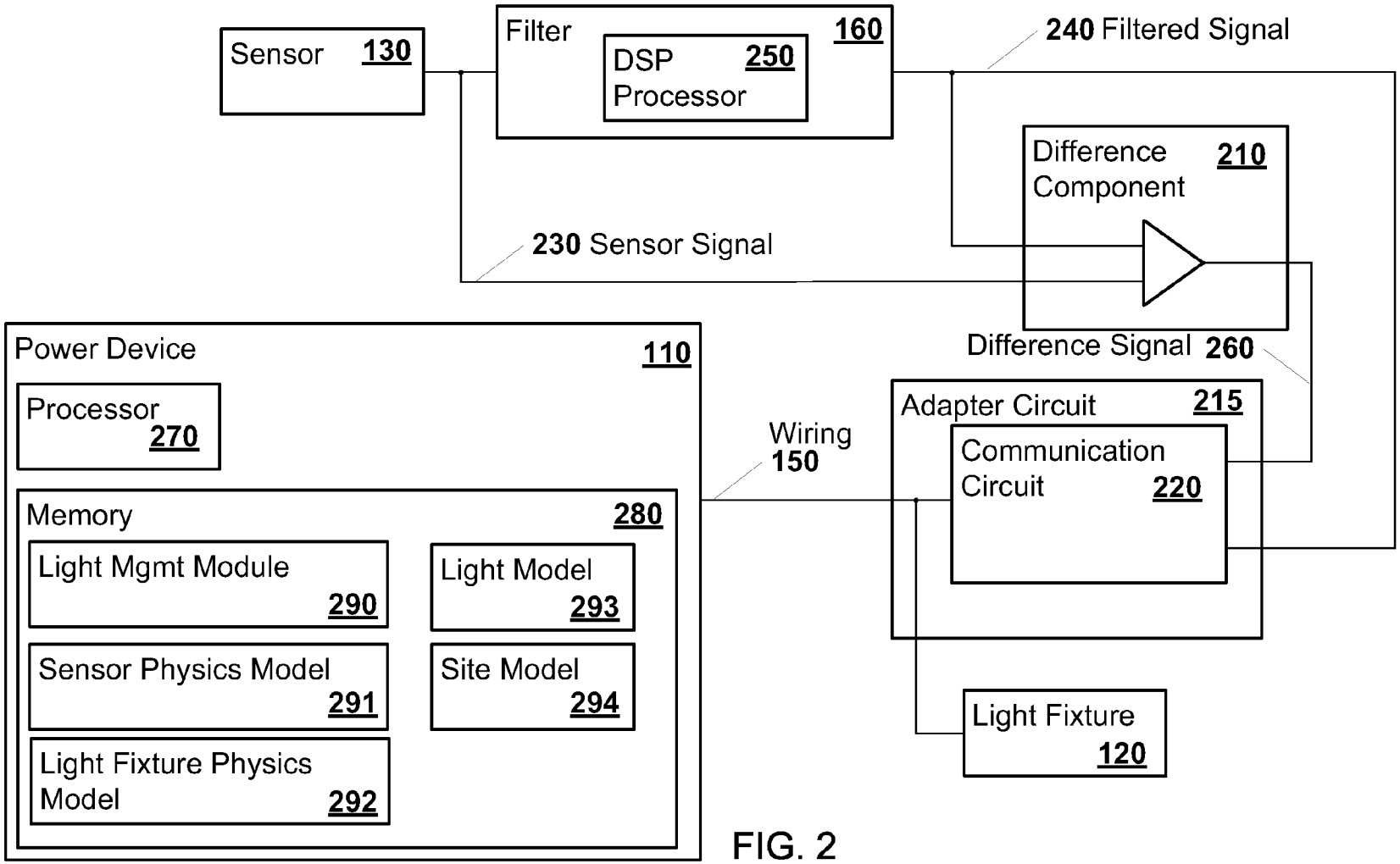
FIG. 2 illustrates an example of a filter.

FIG. 2 illustrates an example of the filter 160 and supporting entities such as a difference component 210, an adapter circuit 215, and a communication circuit 220. In the example illustrated in FIG. 2, the adapter circuit 215 includes the communication circuit 220. The components may be arranged in any number of suitable configurations. In one example, the filter 160 may include the difference component 210. In a second example, the adapter circuit 215 may include the filter 160 and the difference component 210.

The adapter circuit 215 may include any device or combination of devices that communicates sensor data over the wiring 150 and that is electrically coupled to the sensor 130 or in communication with the sensor 130. The adapter circuit 215 may be implemented as any type of circuit, such as an application specific integrated circuit (ASIC), a field programmable gate array (FPGA), a digital circuit, an analog circuit, or any combination thereof. In some examples, the adapter circuit 215 may be electrically coupled to the light fixture 120 and or the shading device 180.

During operation of system 100, the sensor 130 may generate a sensor signal 230 that is received by the filter 160. The sensor signal 230 may be a digital or analog signal that indicates the amount of light sensed by the sensor 130. For example, the amplitude of the sensor signal 230 may represent the amount of light that the sensor 130 senses. The light detected by the sensor 130 may include light from one or more of the light fixtures 120. Alternatively or in addition, the light detected by the sensor 130 may include light from non-system light sources, such as sunlight 170.

The filter 160 may filter the sensor signal 230 using one or more elements. For example, the filter 160 may include a digital signal processor (DSP) 250 that filters the sensor signal 230. The filter 160 may receive the sensor signal 230, filter the sensor signal 230, and generate a filtered signal 240 as an output signal of the filter 160. The filtered signal 240 may indicate the amount of light that is received by the sensor 130 from one or more of the light fixtures 120 even if light from sources other than the one or more of the light fixtures 120 is also received by the sensor 130. For example, the filter 160 may include a band-pass filter that generates the filtered signal 240, where the filtered signal 240 includes the frequency component of the sensor signal 230 that is centered at the modulation frequency of the power signal powering one or more of the light fixtures 120. In a contrasting example, the filter 160 may include a notch filter that generates the filtered signal 240, where the filtered signal 240 excludes the frequency component of the sensor signal 230 that is centered at the modulation frequency of the power signal powering one or more of the light fixtures 120. Alternatively, the filtered signal 240 may indicate the amount of light in the lighting area 140 from a non-system light source such as the sun. A frequency component may be considered blocked or substantially blocked if the amplitude of the frequency component in the filtered signal 240 is less than 10 percent of the amplitude of the frequency component in the sensor signal 230.

The difference component 210 may subtract the filtered signal 240 from the sensor signal 230 in order to generate a difference signal 260. The difference component 210 may be implemented using any number of mechanisms. In one example, the difference component 210 may include an operational amplifier configured to subtract two input signals: the sensor signal 230 and the filtered signal 240. In a second example, the difference component 210 may include a digital component that calculates the difference between the amplitudes of the sensor signal 230 and the filtered signal 240.

The difference signal 260 may represent the opposite of the filtered signal 240. For example, if the filtered signal 240 represents the amount of system light detected, then the difference signal 260 may represent the amount of non-system light detected. Alternatively, if the filtered signal 240 represents the amount of non-system light detected, then the difference signal 260 may represent the amount of system light detected. The difference signal 260 is a filtered signal derived from the sensor signal 230. Accordingly, the filtered signal may refer to the output of the difference component 210 or any other component of the filter 160, such as the DSP processor 250.

The communication circuit 220 may include any circuit configured to transmit data. The communication circuit 220 may transmit the filtered signal 240, the difference signal 260, or a combination thereof to the power device 110. Alternatively, or in addition, the communication circuit 220 may transmit a portion or information about the filtered signal 240, the difference signal 260, or a combination thereof to the power device 110. The communication circuit 220 may transmit data to the power device over the wiring 150. Alternatively, the communication circuit 220 may transmit the data wirelessly, over optical fiber, or over any other type of network.

FIG. 2 also illustrates an example of the power device 110. The power device 110 may include a processor 270 and a memory 280. The power device 110 may include additional, fewer, or different components. For example, the power device 110 may include a network interface or a communication circuit for communication data to and from the communication circuit 220. The power device 110 may include one or more power converters for powering devices such as the light fixtures 120.

The memory 280 may hold the programs and processes that implement the logic described above for execution by the processor 270. As examples, the memory 280 may store program logic that implements a light management module 290, a sensor physics model 291, a light fixture physics model 292, a light model 293, and a site model 294. The memory 280 may include additional, fewer, or different programs or structures. For example, the memory 280 may include different models than those illustrated in FIG. 2. The models 291, 292, 293, and 294, may be implemented in any number of ways ranging from extremely simple to very complex.

The light management module 290 may perform daylight harvesting and/or light management operations. Alternatively or in addition, the light management module 290 may cause the light fixtures 120 to be powered, and/or the shading device 180 or multiple shading devices to be adjusted such that the target balance of light from multiple light sources is reached.

The sensor physics model 291 may model the sensors 130 in the system 100. The sensor physics model 291 may determine the amount of light in the lighting area 140 based on an output of the sensor 130 and/or the filter 160. The sensor physics model 291 may include a sensor model for each type of sensor 130. Each sensor model may include power and longevity sub-models, as well as a sub-model for the light sensed. The sub-models may be based on device characterization and historical data. In one example, the sensor physics model 291 may process the output of the sensor 130 and/or the filter 160.

The light fixture physics model 292 may model each one of the light fixtures 120 in the system 100. The light fixture physics model 292 may predict or indicate how much light may be generated by any of the light fixtures 120 when the corresponding light fixture 120 is supplied a determined power level. Conversely, the light fixture physics model 292 may predict or indicate how much power to provide any of the light fixtures 120 in order for the corresponding light fixture 120 to generate a determined amount of light. The light fixture physics model 292 may include a model for each type of light fixture. The model for each type of fixture may include light, power, thermal, and longevity sub-models based on device characterization and historical data. Lamp drive may be at least a portion of the power level for the light fixture, minus inefficiencies in the light fixture electronics. The thermal sub-model may determine thermal predictions based on the power level for the light fixture 120 and on the efficiency of the electronics of the light fixture 120. Alternatively or in addition, the light fixture physics model 292 may model each shading device 180 in the system 100. The light fixture physics model 292 may predict or indicate how much light may pass through the shading device 180 when the shading device 180 is supplied a determined shade adjustment level or a determined shade level.

The site model 294 may model the static architecture and dynamic physics of a physical site and the system 100. For example, the site model 294 may include architectural data that identifies locations, such as work spaces, work surfaces, transit corridors, and common areas, as well as the location and size of architectural features such as partitions, walls 145, doors, windows, vents, and work areas and surfaces. The site model 294 may also include fixture data that identifies locations of fixtures, such as the light fixtures 120, the sensors 130, and the shading devices 180, relative to the architectural features. The physical site may include the lighting areas 140.

The light model 293 may capture architectural characteristics specific to light, such as the reflectivity of walls, floors, ceilings, and work surfaces. The light model 293 may include a total light model that combines the architectural characteristics specific to light with an artificial light model and a natural light model to form a complete model of illumination in the physical site.

The natural light model may augment the site model 294 with specific information that affects natural light entry (for example, windows, skylights, and light pipes) and moderation (for example, shading devices 180, such as blinds and awnings). The natural light model may include sub-models for direct and indirect natural light sources as a function of geographic location, time of day, day or year, and historical weather data. For example, sunlight 170 may be received from a direct natural light source. Alternatively or in addition, sunlight 170 may include indirect natural light that enters through a skylight, for example.

The artificial light model may augment the light fixture model 292 with information about artificial light generation by the light fixtures 120 and by non-system artificial light sources. The artificial light model may include sub-models specific to purpose, such as models for task, transit, safety, and aesthetic lighting.

During operation of the system 100, the sensor physics model 291, the light fixture physics model 292, the light model 293, and the site model 294 may interoperate in order to accurately predict light levels in one or more of the lighting areas 140.

The light fixture physics model 292, the light model 293, and the site model 294 together may accurately predict illuminance at a target work surface or other type of lighting area 140 due to direct and/or overlapping sources of light generated or controlled by the system 100. The light fixture physics model 292 may characterize the light fixtures 120 for efficacy and luminance. Efficacy and luminance characteristics may be available, for example, from a manufacturer of the light fixture 120. The site model 294 may characterize the geometry associated with any of the light fixtures 120 and shading devices 180. The geometry and surface materials may be provided during pre-commissioning in the form of site architectural plans, for example. Alternatively or in addition, the geometry and the surface materials may be provided during commissioning, on site, by manual observation and measurement. The light model 293 may characterize surface reflectivity and architecture that may be associated with a secondary lighting effect.

Similarly, the light fixture physics model 292, the light model 293, and the site model 294 together may accurately predict illuminance at a target work surface or other type of lighting area 140 due to direct and/or overlapping sources of non-system light. The light fixture physics model 292, the light model 293, and the site model 294 together may characterize the shading device 180 for attenuation and geometry. Shading effect and attenuation as a function of shade control may be available from a manufacturer of the shading device 180. The models 292, 293, and 294 may accurately predict, based on time of day, day of year, and/or geographic location and orientation, the amount of sunlight 170 in any of the lighting areas 140.

The light fixture physics model 292, the light model 293, and the site model 294 may facilitate prediction of the amount of light, such as illuminance, at the lighting area 140 due to direct and indirect (reflected) light from the light fixtures 120 and non-system light sources, natural or artificial. The sensor physics model 291 may determine the amount of light detected at the lighting area 140 from a light source based on one or more outputs of the sensor 130 and/or the filter 160.

During operation of the system 100, the light management module 290 may receive, from the sensor 130, an indication of the amount of light in the lighting area 140 that is received from a secondary light source, such as the sun or a selected one of the light fixtures 120. The light management module 290 may receive the filtered signal 240, which includes the indication of the amount of light in the lighting area 140 received from the secondary light source. Alternatively or in addition, the light management module 290 may receive a value that indicates the amount of light in the lighting area 140 that is received from the secondary light source.

Based on the indication of the amount of light in the lighting area 140 that is received from the secondary light source, the light management module 290, in combination with the sensor physics model 291, may determine the actual amount of light in the lighting area 140 that is received from the secondary light source. For example, the light management module 290 may pass the indication of the amount of sunlight to the sensor physics model 291, which in turn may process the indication to arrive at the actual amount of sunlight 170 in the lighting area 140. Alternatively, the light management module 290 may treat the indication of the amount of light as the actual amount of light in the lighting area 140 that is received from the secondary light source.

The light management module 290 may determine an amount of light that is to be added to the amount of light in the lighting area 140 received from the secondary light source such that a target light level in the lighting area 140 is reached. For example, the light management module 290 may determine the amount of light to be added as a difference between the target light level and the amount of light determined to be in the lighting area 140 from the secondary light source. The amount of light to be added may be referred to as a delta amount of light.

The light management module 290, in combination with the light fixture physics model 292, the light model 293, and the site model 294, may determine a target power level to provide to the light fixture 120 that would generate the delta amount of light. For example, the light management module 290 may determine which of the light fixtures 120 illuminate the lighting area 140 from the site model 294. The light model 293 and the light fixture physics model 292 may predict that supplying a target power level to the light fixture(s) 120 that illuminate the lighting area 140 would generate the delta amount of light.

The light management module 290 may cause the power device 110 or other device to power the light fixture(s) 120 that illuminate the lighting area 140 with the target power level. As a result, the amount of light in the lighting area 140 may be equal to the delta amount of light from the light fixture(s) 120 plus the amount of light from the secondary light source. Accordingly, the amount of light in the lighting area 140 may be equal to the target light level.

Inaccuracies in any of the models 291, 292, 293, and 294 may result in the amount of light in the lighting area 140 not being equal to the target light level. If the filter 160 indicates that the amount of light in the lighting area 140 from the light fixture(s) 120 does not match the delta amount of light, then the light management module 290 may cause a suitable adjustment in the amount of power supplied to the light fixture(s) 120 so that the amount of light in the lighting area 140 from the light fixture(s) 120 matches the delta amount of light.

The amount of light in the lighting area 140 from the secondary light source may change. For example, if the secondary light source is the sun, then the amount of sunlight 170 may change as the earth rotates and/or the weather varies. If the filter 160 indicates that the amount of light in the lighting area 140 from the secondary light source changes, then the light management module 290 may re-determine the delta amount of light and the target power level, and cause the light fixture(s) 120 to be powered according to the new target power level.

If the delta amount of light is negative, then the amount of light in the lighting area 140 may be greater than the target light level. In response to the delta amount of light being negative, the light management module 290 may decrease the amount of light in the lighting area 140 that is received by the secondary light source. For example, in response to the delta amount of light being negative, the light management module 290 may increase the amount of shading provided by one or more of the shading devices 180 so that the amount of sunlight 170 in the lighting area 140 matches the target light level. In addition, the light management module 290 may shutoff the light fixture(s) 120 that illuminate the lighting area 140 if the light from the secondary light source is at the target light level.

The differentiation between internal and external light sources facilitates light source adjustment and balance for aesthetics. For example, a target balance may be provided that is for an aesthetic effect. The target balance may indicate a corresponding amount of light in the lighting area 140 that is to be received from a corresponding one of multiple light sources. The filter 160 may indicate the amount of light that is received from each light source. The light management module 290 may cause an adjustment in the amount of light in the lighting area 140 from each of the light sources (such as the light fixtures 120 and non-system light sources) until the target balance is reached. The sensor physics model 291, the light fixture physics model 292, the light model 293, and the site model 294 may increase the speed at which the target balance is reached and limit over and undershoot involved in other types of feedback systems.

The light fixtures 120 and the corresponding sensors 130 may be located so as to be in multiple lighting areas 140 that are reached by sunlight 170 or other non-system light. The amount of sunlight 170 or other non-system light may vary across the lighting areas 140. If the lighting areas 140 are in one room, then the lighting areas 140 may form a light intensity plane or a non-linear light intensity profile in which the amount of light from each corresponding one of the light fixtures 120 varies from lighting area 140 to lighting area 140. The amount of light from each corresponding one of the light fixtures 120 may vary even if the target light level at each one of the lighting areas 140 is the same as at the other lighting areas 140. For example, the light levels generated by the light fixtures 120 may change smoothly across the room, where the dimmest light fixture 120 is nearest to the non-system light source and the brightest light fixture 120 is the furthest from the non-system light source. In applying the light intensity profile, the system 100 may achieve the overall target lighting level while minimizing power usage and providing light that is more aesthetically pleasing to the occupants. A light intensity profile for glare situations may be determined or included for glare mitigation. In the light intensity profile for glare, the light fixtures 120 nearest a glare source may be brighter than the other light fixtures 120 in the lighting area 140 in order to achieve a higher than normal target light level in the lighting area 140 based on an anticipated pupillary constriction of the eyes of an occupant due to the glare source.

Occupants of the lighting area 140 may be adversely affected by the effects of glare. Glare can result from a number of situations. Some glare situations are more common than others in examples where the lighting area 140 is lit by a mix of natural and artificial light as is common in work areas. Glare may result in the light area 140 when brightly lit objects are within in an occupant's field of view. For example, glints of sunlight may reflect off of an automobile, an adjacent building window, or some other reflective or semi-reflective surface and enter through a window into the lighting area 140. Such glare may be difficult to detect and control automatically because the glare may be highly directional and unpredictable. Mitigation of such glare may be performed effectively by the occupants of the lighting area 140 by manually and selectively adjusting awnings, blinds, or shades. Such manual adjustment may affect the overall light level in the lighting area 140. The system 100 may automatically compensate for the change in the overall light level caused by the manual adjustment of the shading by the occupant. Glare may also result when the lighting area 140 is lit by large bright areas of natural light nearby the lighting area 140. For example, the bright areas may include brightly lit streets and walkways, buildings, and thin overcast shining through windows. Such a situation may cause the pupils of an occupant to contract, thereby rendering a normal target light level for the lighting area 140 ineffective. For example, the work surfaces may appear too dim for the occupant to perform work tasks. By measuring and predicting the exposure and/or direction of such natural light sources through windows, and that of artificial light from the light fixtures 120, with the models 291, 292, 293, and 294, and measuring the difference in intensity between natural and artificial light with the filters 160, the system 100 may mitigate the glare by adjusting the position and/or amount of shade provided by the shading device 180, shifting the light balance towards artificial light produced by the light fixtures 120, and/or increasing the target light level for the lighting area 140 above the target light level that is applicable to a non-glare situation.

The system 100 may be implemented in many different ways. For example, although some features are shown stored in computer-readable memories (e.g., as logic implemented as computer-executable instructions or as data structures in memory), parts of the system 100 and its logic and data structures may be stored on, distributed across, or read from other machine-readable media. The media may include hard disks, floppy disks, CD-ROMs, and flash drives.

The system 100 may be implemented with additional, different, or fewer entities. As one example, the processor 270 may be implemented as a microprocessor, a microcontroller, a DSP, an application specific integrated circuit (ASIC), discrete logic, or a combination of other types of circuits or logic. As another example, the memory 280 may be a non-volatile and/or volatile memory, such as a random access memory (RAM), a read-only memory (ROM), an erasable programmable read-only memory (EPROM), flash memory, any other type of memory now known or later discovered, or any combination thereof. The memory 280 may include an optical, magnetic (hard-drive) or any other form of data storage device.

The filter 160 may include additional, fewer, or different components. For example, the filter 160 may include the difference component 210. Alternatively or in addition, the filter 160 may include a processor and a memory such as the processor 270 and the memory 280 of the power device 110.

The processing capability of the system 100 may be distributed among multiple entities, such as among multiple processors and memories, optionally including multiple distributed processing systems. Parameters, databases, and other data structures may be separately stored and managed, may be incorporated into a single memory or database, may be logically and physically organized in many different ways, and may implemented with different types of data structures such as linked lists, hash tables, or implicit storage mechanisms. Logic, such as programs or circuitry, may be combined or split among multiple programs, distributed across several memories and processors, and may be implemented in a library, such as a shared library (e.g., a dynamic link library (DLL)).

The processor 270 may be in communication with the memory 280. In one example, the processor 270 may also be in communication with additional components, such as a network interface and a display. The processor 270 may be a general processor, central processing unit, server, application specific integrated circuit (ASIC), digital signal processor, field programmable gate array (FPGA), digital circuit, analog circuit, or combinations thereof.

The processor 270 may be one or more devices operable to execute computer executable instructions or computer code embodied in the memory 280 or in other memory to perform the features of the system 100. The computer code may include instructions executable with the processor 270. The computer code may include embedded logic. The computer code may be written in any computer language now known or later discovered, such as C++, C#, Java, Pascal, Visual Basic, Perl, HyperText Markup Language (HTML), JavaScript, assembly language, shell script, or any combination thereof. The computer code may include source code and/or compiled code.

Although some features are shown stored in computer-readable memories (e.g., as logic implemented as computer-executable instructions or as data structures in memory), all or part of the logic may be implemented as hardware. For example, the light management module 290 may be implemented as digital or analog circuit.

Figure 3:
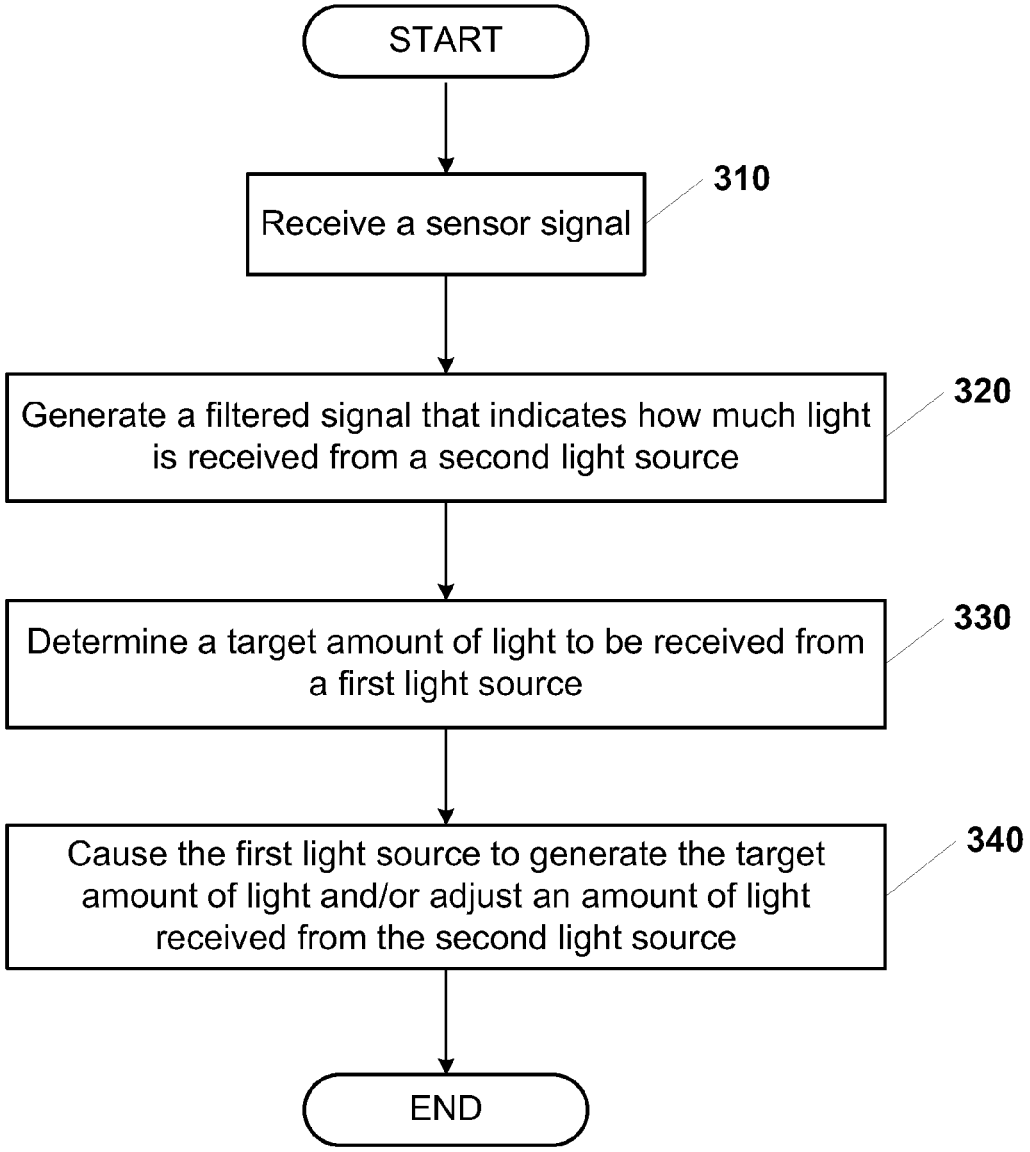
FIG. 3 illustrates an example flow diagram of logic for light management or light balancing.

FIG. 3 illustrates an example flow diagram of the logic of a system for light management or light balancing. The operations may be executed in a different order than illustrated in FIG. 3. The logic may include additional, fewer, or different operations than are illustrated in FIG. 3.

The sensor signal 230 that indicates an amount of light detected in the lighting area 140 by the sensor 130 may be received (310). For example, the filter 160 may be in a housing that also includes the sensor 130, and the filter 160 may receive the sensor signal 230 from the sensor 130 as an electric signal. In a second example, the filter 160 may receive the sensor signal 230 from an externally coupled sensor 130.

The filtered signal 240 may be generated from the sensor signal 230 by blocking any component of the sensor signal 230 representing light from a first light source and passing any component of the sensor signal 230 representing light from a second light source (320). The first light source may include the light fixture 120 that illuminates the lighting area 140. The filtered signal 240 may indicate the amount of light in the lighting area 140 that is received from the second light source.

A target amount of light to be received from the first light source in the lighting area may be determined based on a target light level for the lighting area 140 and on the amount of light in the lighting area 140 received from the second light source (330). The light fixture 120 may be powered at a target power level at which the light fixture 120 generates the target amount of light (340). Alternatively or in addition, the amount of light received from the second light source may be adjusted. For example, the amount of shading provided by the shading device 180 may be adjusted so that light passing through the shading device 180 from the second light source is adjusted so that the target light level for the lighting area 140 is reached.

The operations may end, for example, by returning to the operation in which the sensor signal 230 is received (310). In a second example, the operations may end by adjusting the target power level provided to the light fixture 120 until the amount of light in the lighting area 140 from the light fixture 120 is the delta amount of light.

All of the discussion, regardless of the particular implementation described, is exemplary in nature, rather than limiting. For example, although selected aspects, features, or components of the implementations are depicted as being stored in memories, all or part of systems and methods consistent with the innovations may be stored on, distributed across, or read from other computer-readable storage media, for example, secondary storage devices such as hard disks, floppy disks, and CD-ROMs; or other forms of ROM or RAM either currently known or later developed. The computer-readable storage media may be non-transitory computer-readable media, which includes CD-ROMs, volatile or non-volatile memory such as ROM and RAM, or any other suitable storage device. Moreover, the various modules and screen display functionality is but one example of such functionality and any other configurations encompassing similar functionality are possible.

Furthermore, although specific components of innovations were described, methods, systems, and articles of manufacture consistent with the innovation may include additional or different components. For example, a processor may be implemented as a microprocessor, microcontroller, application specific integrated circuit (ASIC), discrete logic, or a combination of other type of circuits or logic. Similarly, memories may be DRAM, SRAM, Flash or any other type of memory. Flags, data, databases, tables, entities, and other data structures may be separately stored and managed, may be incorporated into a single memory or database, may be distributed, or may be logically and physically organized in many different ways. The components may operate independently or be part of a same program. The components may be resident on separate hardware, such as separate removable circuit boards, or share common hardware, such as a same memory and processor for implementing instructions from the memory. Programs may be parts of a single program, separate programs, or distributed across several memories and processors.

The respective logic, software or instructions for implementing the processes, methods and/or techniques discussed above may be provided on computer-readable media or memories or other tangible media, such as a cache, buffer, RAM, removable media, hard drive, other computer readable storage media, or any other tangible media or any combination thereof. The tangible media include various types of volatile and nonvolatile storage media. The functions, acts or tasks illustrated in the figures or described herein may be executed in response to one or more sets of logic or instructions stored in or on computer readable media. The functions, acts or tasks are independent of the particular type of instructions set, storage media, processor or processing strategy and may be performed by software, hardware, integrated circuits, firmware, micro code and the like, operating alone or in combination. Likewise, processing strategies may include multiprocessing, multitasking, parallel processing and the like. In one embodiment, the instructions are stored on a removable media device for reading by local or remote systems. In other embodiments, the logic or instructions are stored in a remote location for transfer through a computer network or over telephone lines. In yet other embodiments, the logic or instructions are stored within a given computer, central processing unit ("CPU"), graphics processing unit ("GPU"), or system.

While various embodiments of the innovation have been described, it will be apparent to those of ordinary skill in the art that many more embodiments and implementations are possible within the scope of the innovation. Accordingly, the innovation is not to be restricted except in light of the attached claims and their equivalents.

What is claimed is:

1. A system for light management comprising:

a sensor configured to generate a sensor signal that indicates an amount of light detected in a lighting area by the sensor;

a filter configured to generate a filtered signal from the sensor signal such that the filter at least partially blocks a component of the sensor signal representing light from a first light source and at least partially passes a component of the sensor signal representing light from a second light source, the first light source including a light fixture that illuminates the lighting area, the filtered signal indicating an amount of light in the lighting area received from the second light source; and a light management module configured to determine a target amount of light to be received from the first light source in the lighting area based on a target light level for the lighting area and on the filtered signal indicating an amount of light in the lighting area received from the second light source, wherein the light management module is further configured to cause the light fixture to be powered at a target power level at which the light fixture generates the target amount of light, wherein the light fixture included in the first light source comprises a first light fixture, and wherein the second light source comprises a second light fixture that the light management module is not configured to control.

2. The system of claim 1, further comprising a light fixture model configured to determine the target power level for the light fixture from the target amount of light, wherein if the light fixture is powered at the target power level then the light fixture generates the target amount of light.

3. The system of claim 1, wherein the light management module is further configured to adjust an amount of light in the lighting area that is received from the first light source and the second light source until a target balance in the lighting area is reached.

4. A system for light management comprising:

a sensor configured to generate a sensor signal that indicates an amount of light detected in a lighting area by the sensor;

a filter configured to generate a filtered signal from the sensor signal such that the filter at least partially blocks a component of the sensor signal representing light from a first light source and at least partially passes a component of the sensor signal representing light from a second light source, the first light source including a light fixture that illuminates the lighting area, the filtered signal indicating an amount of light in the lighting area received from the second light source; and a light management module configured to determine a target amount of light to be received from the first light source in the lighting area based on a target light level for the lighting area and on the filtered signal indicating an amount of light in the lighting area received from the second light source, wherein the light management module is further configured to cause the light fixture to be powered at a target power level at which the light fixture generates the target amount of light, and wherein the light management module is further configured to cause a shading device to adjust an amount of shading for adjustment of the amount of light in the lighting area received from the second light source.

5. The system of claim 4, wherein the light from the second light source includes sunlight.

6. A method for light management comprising:

receiving a sensor signal that indicates an amount of light detected in a lighting area by a sensor;

generating a filtered signal from the sensor signal by at least partially blocking a component of the sensor signal representing light from a first light source and at least partially passing a component of the sensor signal representing light from a second light source, the first light source including a light fixture that illuminates the lighting area, the filtered signal indicating an amount of light in the lighting area received from the second light source;

determining a target amount of light to be received from the first light source in the lighting area based on a target light level for the lighting area and on the filtered signal indicating an amount of light in the lighting area received from the second light source;

causing the light fixture to be powered at a target power level at which the light fixture generates the target amount of light; and reducing glare in the lighting area by performing operations comprising:

adjusting the amount of light produced by the first light source; and adjusting an amount of attenuation of light from the second light source based on control of a shading device.

7. The method of claim 6, wherein the light from the second light source includes sunlight.

8. The method of claim 6, further comprising adjusting a corresponding amount of light in the lighting area that is received from the first light source and the second light source until a target balance in the lighting area is reached.

9. A method for light management comprising:

filtering a signal representing light in a lighting area to represent an amount of sunlight in the lighting area;

adjusting a light output of a light fixture in the lighting area in response to the filtering, to generate a target amount of light in the lighting area taking into account the amount of sunlight in the lighting area; and attenuating the amount of sunlight in the lighting area in response to the filtering.

10. The method of claim 9 wherein the light fixture is a first light fixture and wherein the adjusting comprises:

adjusting a light output of the first light fixture in the lighting area in response to the filtering and further in response to light in the lighting area that is generated by a second light fixture, to generate a target amount of light in the lighting area taking into account the amount of sunlight in the lighting area and the amount of light that is generated by the second light fixture.

11. The method of claim 9 wherein the light fixture is a first light fixture and wherein the adjusting comprises:

adjusting a light output of the first light fixture and a light output of a second light fixture in the lighting area in response to the filtering to generate a target amount of light in the lighting area taking into account the amount of sunlight in the lighting area.

12. The method of claim 9 wherein the second light fixture comprises a fluorescent light fixture or a wall washer light fixture.

* * * * *